US006055785A

United States Patent [19]

Counihan

[11] Patent Number: 6,055,785

[45] Date of Patent: May 2, 2000

[54] RESILIENT FLOORING

[76] Inventor: James Counihan, 50 Griffin Mill Rd., Piedmont, S.C. 29673

[21] Appl. No.: 09/129,829

[22] Filed: Aug. 5, 1998

[51] Int. Cl.[7] ..... E04B 5/00

[52] U.S. Cl. ..... 52/403.1; 52/480

[58] Field of Search ..... 52/403.1, 480, 52/710

[56] References Cited

U.S. PATENT DOCUMENTS

| | | | |
|---|---|---|---|
| Re. 18,573 | 8/1932 | Kocher | 52/480 X |
| 1,195,289 | 8/1916 | Stevens . | |
| 1,302,578 | 5/1919 | Murphy . | |
| 1,693,655 | 12/1928 | Murphy . | |
| 2,115,238 | 4/1938 | Stevens | 52/403.1 X |
| 2,862,255 | 12/1958 | Nelson . | |
| 3,387,422 | 6/1968 | Wanzer | 52/403.1 X |
| 4,831,806 | 5/1989 | Niese et al. . | |
| 4,856,250 | 8/1989 | Gronau et al. . | |
| 4,890,434 | 1/1990 | Niese . | |
| 4,945,697 | 8/1990 | Ott et al. | 52/403.1 |
| 5,016,413 | 5/1991 | Counihan | 52/403.1 X |
| 5,369,927 | 12/1994 | Counihan . | |
| 5,388,380 | 2/1995 | Niese | 52/403.1 X |
| 5,497,590 | 3/1996 | Counihan | 52/403.1 X |
| 5,647,183 | 7/1997 | Counihan | 52/403.1 |
| 5,778,621 | 7/1998 | Randjelovic | 52/403.1 |
| 5,906,082 | 5/1999 | Counihan | 52/403.1 |

FOREIGN PATENT DOCUMENTS

| | | |
|---|---|---|
| 24452 | 5/1936 | Australia . |

*Primary Examiner*—Carl D. Friedman
*Assistant Examiner*—Kevin D. Wilkens
*Attorney, Agent, or Firm*—Henry S. Jaudon; Cort Flint

[57] ABSTRACT

A resilient flooring formed over a non-resilient base floor comprising an upper surface of hardwood flooring secured with a subsurface of plywood panels and a plurality of spaced parallel sleepers arranged across the base floor for supporting the flooring and subsurface. Each sleeper is formed with an upper surface and lower surface of equal width and opposed vertical sides. The upper surface supports and is secured with the subsurface. The lower surface of each sleeper includes a pillow of resilient material secured therewith which act to separate the sleeper from the sub-floor. Parallel grooves are formed in the opposed sides of each sleeper and securing clips having upper extensions are arranged along opposite sides of each sleeper with the extensions extending to the parallel grooves. The securing clips are secured with the sub-flooring. The flooring is allowed limited vertical movement, the extent of which is determined by the thickness of the resilient material and the distance of the upper extensions from the base floor.

15 Claims, 2 Drawing Sheets

RESILIENT FLOORING

BACKGROUND OF THE INVENTION

The instant invention comprises a resilient flooring structure designed for installation over an existing non-resilient base floor.

Resilient flooring structures are well known in the industry. U.S. Pat. Nos. 1,302,578; 1,195,289; 2,862,255; and 4,856,250 disclose examples of various prior art arrangements.

U.S. Pat. No. 5,369,927 to Counihan shows yet another variation of a resilient flooring structure. The instant application is an improvement of the Counihan flooring structure and the disclosure of the referred to patent is incorporated herewith.

It has been found that a resilient flooring structure requires several structural features in order to provide a satisfactory product. A first requirement is stability of the sleeper members, i.e., the sleepers must be fixedly located relative to each other in order that the flooring presents a surface which reacts uniformly to loads. Another requirement is ease of installation. In order to be economically competitive, the installation must not be excessively time consuming. Another is continued uniform performance. The resilient action must remain constant and uniform over the life of the floor.

It is therefore a primary object of the instant invention to provide a resilient flooring structure which is capable of being installed quickly and uniformly.

Another object of the instant invention is a resilient flooring structure in which the resilient action is controlled within desired limits.

Another object of the invention is a resilient flooring structure in which the flooring is uniformly and evenly supported by the sleepers over the entire flooring area.

SUMMARY OF THE INVENTION

The instant invention is directed to a resilient flooring which is designed to be installed over a non-resilient base floor. The resilient flooring includes a plurality of spaced parallel sleepers arranged across the base floor in a first direction. The sleepers comprise upper and lower parallel surfaces opposed vertical sides and longitudinal grooves formed along the opposed vertical sides. The grooves are formed with upper and lower horizontal shoulders. A cushion of resilient material is arranged over the base floor to extend beneath at least a portion of each of the sleepers.

Securing clips are arranged alongside the sleepers. Each clip includes a first extension extending into the groove to be normally in contact with the upper surface of its lower shoulder. A second extension of such clips is secured with the base floor.

A sub-flooring, comprising plywood panels, is positioned to overlay the upper surfaces of the sleepers. The panels are secured with the sleepers. Flooring planks are secured with the sub-flooring panels providing the finished flooring surface.

The clips act to retain the sleepers in parallel alignment and also act to control the vertical downward movement of the flooring a distance no greater than the width of the groove or the compressed thickness of the resilient material. The height of the upper clip extension controls the upper vertical position of the flooring.

The sleepers are formed with upper and lower surfaces of equal width and length. The grooves, formed in the vertical sides, are continuous and the upper and lower shoulders are parallel with the upper and lower surfaces of the sleepers.

The cushion may comprise continuous resilient strips of a width substantially equal that of the lower surface of the sleepers. Alternatively the cushion may comprise individual resilient pods arranged at spaced intervals beneath along the lower surface of the sleepers. The strips or pods may or may not be secured with the sleepers. Yet another arrangement provides for the resilient material to be a floor covering.

Each of the clips comprise a vertical leg. The first and second extension are connected to opposed ends of the leg and extend in opposite directions. Each clip is formed to be between 6" and 12" in length. In use, the clips are preferably arranged opposite each other along the opposed vertical sides. Alternatively, they may be staggered.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
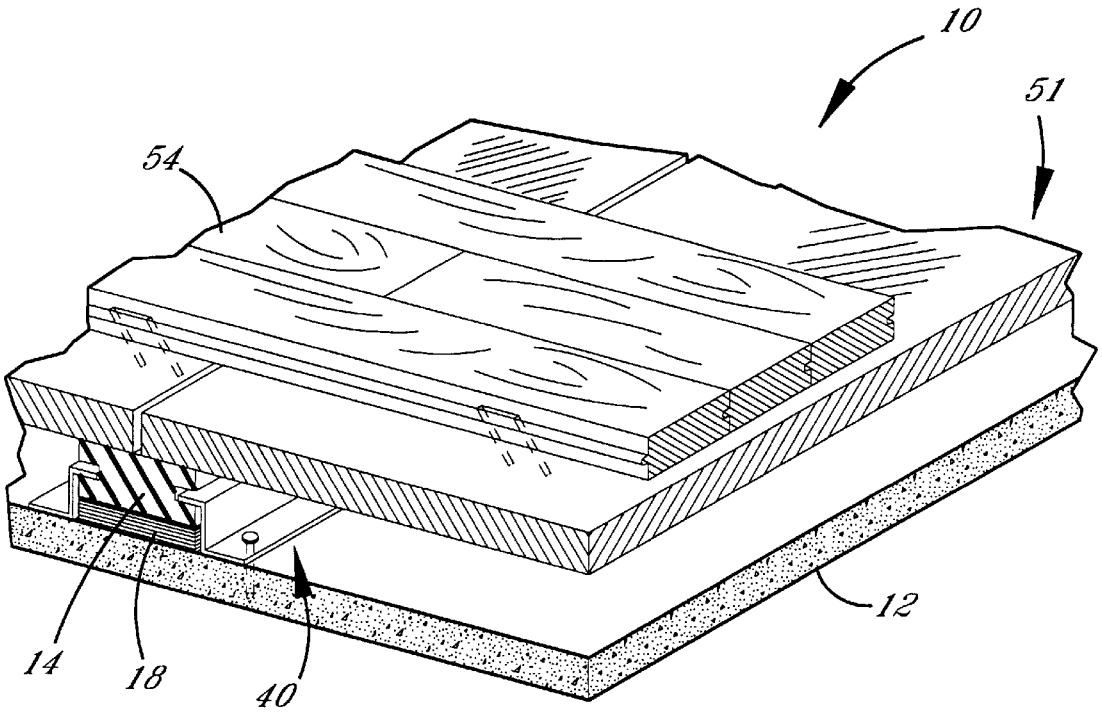
FIG. 1 is a sectional perspective view of the resilient flooring arrangement of the invention.
Figure 2:
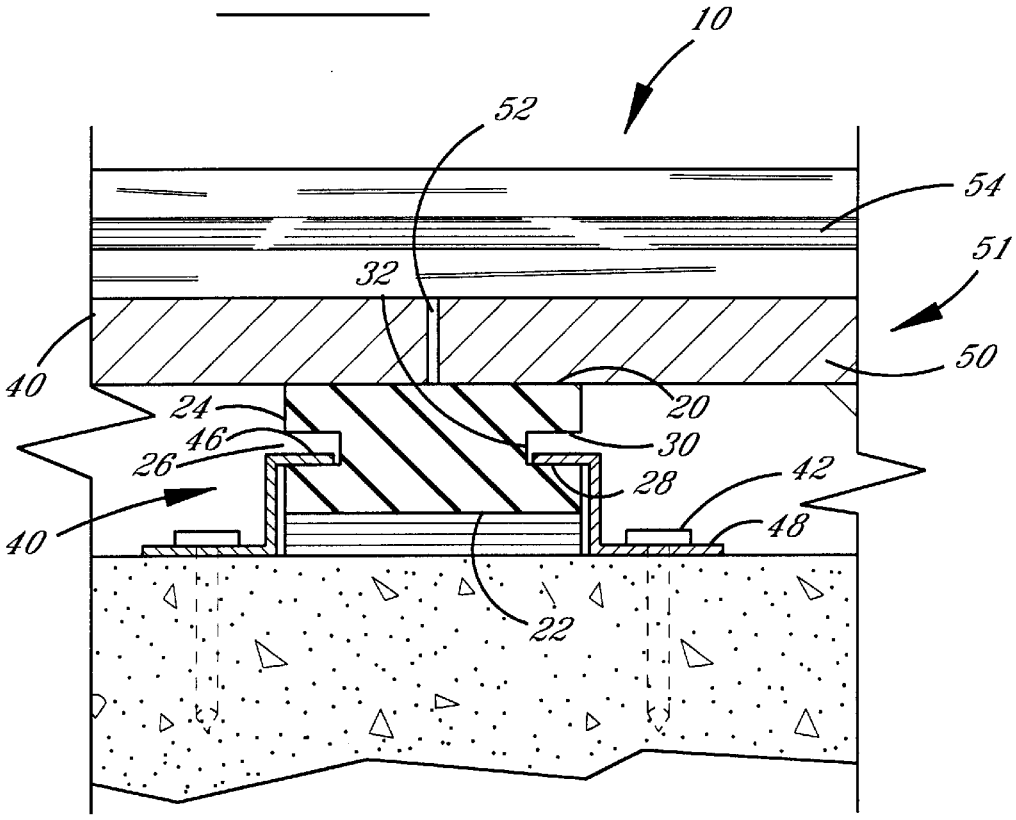
FIG. 2 is a sectional end view of the resilient flooring arrangement of the invention.
Figure 3:
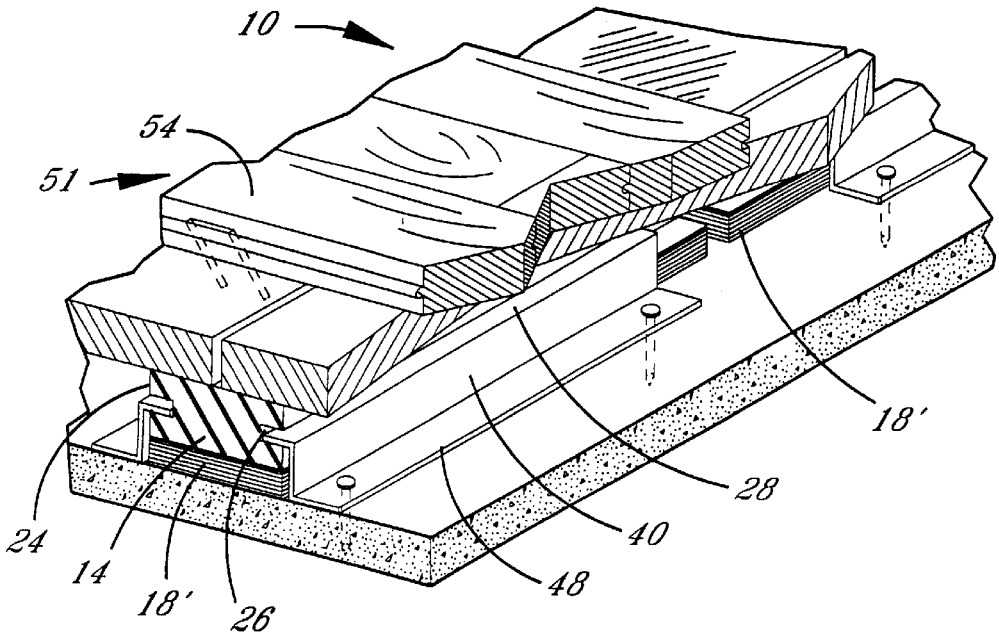
FIG. 3 is a sectional cutaway of FIG. 1 showing the securing clip structure for the sleepers.
Figure 4:
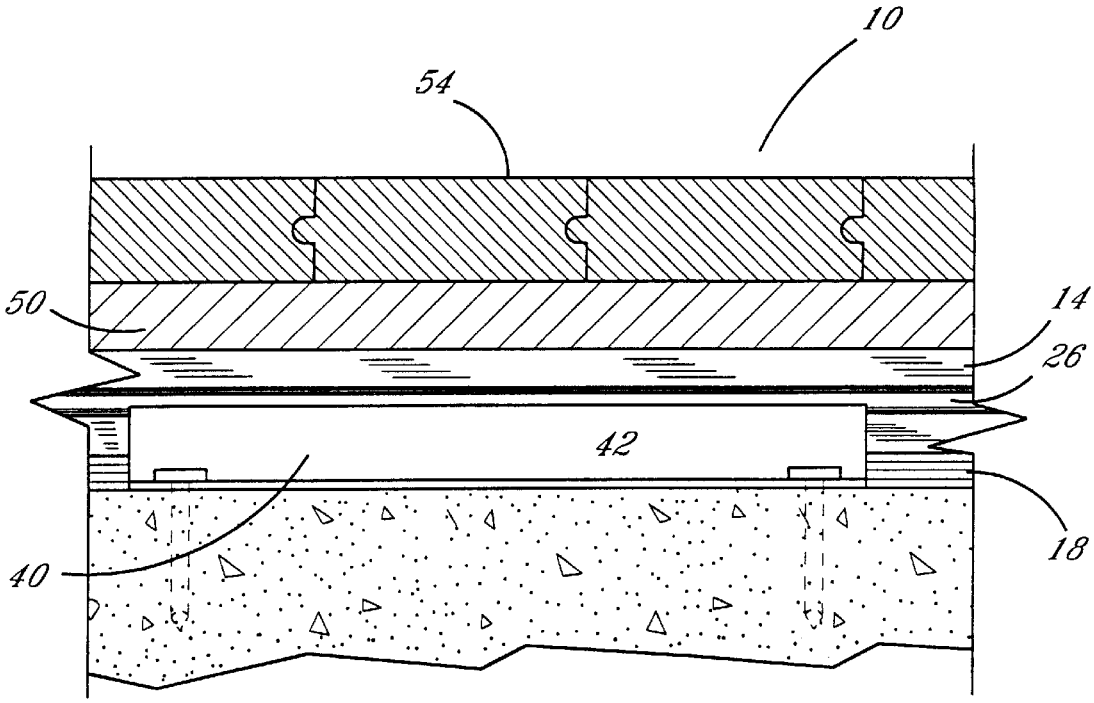
FIG. 4 is a side sectional cutaway view of the resilient flooring arrangement of the invention.

Turning now to the drawings, the resilient flooring system 10, of the invention, is shown in the sectional views of FIGS. 1–4. Flooring system 10 is designed to be laid over a non-resilient base floor 12 which is usually concrete. The resilient flooring system is designed to provide a sturdy solid flooring structure which is capable of limited and controlled flexibility.

Flooring 10 comprises a plurality of sleepers 14 arranged in spaced parallel positions across a base floor 12. Sleepers 14 are spaced at equal intervals, normally between 14.5" and 22.5" apart.

Each sleeper 14 rests on a resilient cushion 18 or a plurality of pods 18" which are preferably ½" thick. Obviously, the thickness of the cushion may be more or less depending upon need. Cushion 18 may be of synthetic foam material or of rubber. It may be coated over its lower surface to prevent water or moisture absorption. Cushion 18 preferably is of a width equal that of sleeper 14 and extends continuously beneath the sleeper across the width of the floor. Cushion 18 may be secured with the lower surface of each sleeper prior to installation by an adhesive or by tacks.

Alternatively cushion 18 may be a single resilient piece which covers the entire base floor. In this arrangement, sleepers 14 are positioned on top of the resilient floor covering.

Yet another alternative arrangement comprises a plurality of individual resilient members or pods secured with the lower side of the sleeper at spaced intervals. U.S. Pat. No. 5,369,927 discloses the use of such type of resilient padding.

Each sleeper 14 preferably comprises a plurality of studs, normally referred to as 2×4, arranged end to end across the floor. Each sleeper includes parallel upper and lower support surfaces 20, 22 which are of equal width. This arrangement provides for an even distribution of force across each surface. A pair of vertical sides 24 are formed with opposed grooves 26. Each groove 26, which is cut to about ¾", includes horizontal and parallel upper and lower shoulders 28, 30 along with a vertical end surface 32 which is about ½" in length. The grooves are normally cut along the mid-point of the horizontal sides, however this position may vary up or down as desired.

Securing clips 40 are arranged along each vertical side 24 of sleepers 14 and are secured with base floor 12 by appropriate means such as nails 42. Preferably the clips are between about 6" and 12" long and are spaced at 12" to 24" intervals.

Each clip 40 is formed with a vertical leg 44 which carries at each end a horizontal extension 46, 48. Extensions 46, 48 are directed in opposite directions from leg 44.

Upper extension 46 of each securing clip 40 is positioned to extend into the associated groove 26 and is normally in engagement with lower shoulder 28 due to the upper resilient force of the cushion.

An alternative arrangement could have a first clip 40 on a first side of each sleeper formed of sufficient length to extend continuously along the length of the sleeper. The opposite side of the sleeper would have a plurality of the 12" clips arranged along its length.

U.S. Pat. No. 5,369,927 teaches the use of U-shaped clips cooperating with shoulder members which are usually metal strips attached with the sleepers. Specifically, when aligning the clips along a common axis and attaching them to the floor, it is difficult to maintain alignment. Also, inserting the sleeper to be beneath the inwardly directed clip extensions is difficult. This arrangement presents obvious assembly problems which are time consuming. Finally, the attachment shoulders have a tendency to become disconnected.

By providing shoulders which are an integral part of the sleeper, certain of the indicated disadvantages have been overcome. Also, by providing an upper shoulder to extend over the engaging extension, the engagement area is protected.

By providing individual clip members for securing individually each side of the sleeper another advantage in installation efficiency is achieved.

Sub-flooring 51, which preferably comprises ½" plywood paneling 50 which is positioned over sleepers 14 in end to end contact, is secured with each sleeper 14 with brads, nails, or other suitable means. Joints 52 are formed where ends of opposing panels 50 engage over upper support surface 20 of sleeper 14. Because surface 20 is of a width equal that of the sleeper, each end of the panels 50 can be fastened with the sleeper in a secure and non-yielding fashion.

Panels 50 may be up to ¾" or down to ¼ thick if desired. Also, the panels may be fiber board or other suitable material.

Hardwood flooring 54 is secured with sub-floor 51 by usual means, such as nails or brads, forming the finished surface of flooring 10.

Essential advantages of the disclosed resilient flooring structure are ease of construction and uniformity of construction. The latter is necessary in order that the resilience is uniform over the entire floor area. The former is necessary in order to be competitive.

Flooring 10 is installed by first marking parallel and equally spaced lines across base floor 12. A first row of clips 40 are positioned along each line and are secured with the base floor with nails 42.

Resilient padding 18 is secured with lower surface 22 of 2×4 studs forming sleepers 14 and grooves 26 are formed vertical sides thereof. The studs are positioned against secured clips 40, with extensions 46 positioned above lower shoulder 28, and formed end to end across the base floor to form sleepers 14.

Secured clips 40 secure the accurately located sleepers 14 relative to each other and along the parallel lines. The second row of clips 40 are positioned along the opposite side of each sleeper 14 with extensions 46 overlaying shoulders 28. The positioned clips are secured with the base floor with nails 42 locking sleepers 14 in the desired fixed spaced horizontal relationship.

Sleepers 14, though locked against lateral movement by clips 40, are capable of limited vertical movement which is determined by the compressibility and thickness of resilient cushions 18 and the vertical positions of extension 46 and shoulder 28 relative to base floor 12.

Panels 50 are now positioned over the sleepers. The panels are sized so that opposing ends abut at joints 52 midway of upper surface 20 of the sleeper. Because this surface is equal to that of the sleeper there is ample support surface on which the panels are supported and secured to provide each panel with equal support throughout its length.

Flooring 54 is now secured with sub-flooring 51 in usual manner.

While a preferred embodiment of the invention has been described using specific terms, such description is for illustrative purposes only, and it is to be understood that changes and variations may be made without departing from the spirit or scope of the following claims.

What is claimed is:

1. A floor construction for providing resilient support comprising:

a non-resilient base floor;

a plurality of spaced parallel sleepers arranged on said base floor in a first direction, said sleepers having vertical sides spaced by upper and lower parallel surfaces, said sides having longitudinal grooves having upper and lower shoulders formed therein said shoulders being vertically spaced a prescribed distance;

resilient material located on said base floor and beneath at least a portion of each of said sleepers;

securing clips having first and second extensions;

said first extensions being positioned to extend into said grooves to normally be in contact with said lower shoulders;

said second extensions being fixedly secured with said base floor in fixed positions relative to said sleepers;

panels secured with said upper surfaces of said sleepers, said panels forming a sub-floor;

flooring planks secured with said sub-floor forming a flooring surface; whereby, said clips retain said sleepers in fixed relative lateral positions while allowing said sleepers vertical downward movement no greater than said prescribed distance.

2. The flooring of claim 1 wherein said upper and lower surfaces of said sleepers are of equal width and length.

3. The flooring of claim 1 wherein said grooves are continuous.

4. The flooring of claim 1 wherein said upper and lower shoulders are parallel with said upper and lower surfaces.

5. The flooring of claim 1 wherein said grooves are located approximately midway of said vertical side walls and have an opening of approximately 0.5".

6. The flooring of claim 1 wherein said resilient material comprises continuous cushion strips of a width substantially equal that of said lower surface of said sleepers.

7. The flooring of claim 1 wherein said resilient material comprises pods arranged at spaced intervals beneath said sleepers.

8. The flooring of claim 1 wherein said clips are at least 6" in length.

9. The flooring of claim 1 wherein said clips are arranged opposite each other along said opposed vertical sides.

10. The flooring of claim 1 wherein said upper surface provides continuous support for said subsurface.

11. The flooring of claim 1 wherein each said clip includes a vertical leg, said first and second extensions being connected with opposing ends of said vertical leg.

12. The flooring of claim 11 wherein said first and second extensions extend in opposing directions from said vertical leg.

13. A floor construction for providing resilient support comprising:

a non-resilient base floor;

a plurality of spaced parallel sleepers arranged across said base floor, each said sleeper having an upper surface and a lower surface of equal width and separated by opposed side surfaces;

an upper surface of hardwood flooring secured with a subsurface of plywood panels, said subsurface being secured with said upper surface;

resilient material beneath said sleepers separating said sleepers from said base floor;

a groove having upper and lower parallel shoulders formed in each of said opposed sides;

a plurality of securing clips, each having an upper and a lower extension, said securing clips being in a fixed position relative to said base floor along said opposed sides of said sleepers with said upper extensions extending into said grooves in normally spaced position from said upper shoulders and in contact with said lower shoulders of said grooves, whereby;

said flooring is allowed vertical movement, the extent of said movement being determined by the thickness and compressibility of said resilient material and the vertical distance of said upper extensions from said base floor.

14. The flooring of claim 13 where in said resilient cushion material comprises strip members along the length of said sleeper.

15. The flooring of claim 13 wherein said resilient cushion material comprises pods in spaced positions along said sleepers.

* * * * *